US009482226B2

(12) United States Patent
Yang et al.

(10) Patent No.: US 9,482,226 B2
(45) Date of Patent: Nov. 1, 2016

(54) BLADE-TYPE FLUID TRANSMISSION DEVICE

(71) Applicants: Gene-Huang Yang, Taichung (TW); Shun-Ji Yang, Taichung (TW)

(72) Inventors: Gene-Huang Yang, Taichung (TW); Shun-Ji Yang, Taichung (TW)

( * ) Notice: Subject to any disclaimer, the term of this patent is extended or adjusted under 35 U.S.C. 154(b) by 0 days.

(21) Appl. No.: 14/607,084

(22) Filed: Jan. 28, 2015

(65) Prior Publication Data

US 2015/0139846 A1 May 21, 2015

Related U.S. Application Data

(62) Division of application No. 13/555,201, filed on Jul. 23, 2012, now Pat. No. 8,985,983.

(30) Foreign Application Priority Data

| | | |
|---|---|---|
| Apr. 9, 2012 | (TW) | 101112536 A |
| May 25, 2012 | (TW) | 101118885 A |
| Jun. 21, 2012 | (TW) | 101122318 A |

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 2/344*** | (2006.01) |
| ***F01C 21/08*** | (2006.01) |

(52) U.S. Cl.

CPC ..... *F04C 2/3442* (2013.01); *F01C 21/0809* (2013.01); *F01C 21/0818* (2013.01); *F01C 21/0836* (2013.01); *F01C 21/0863* (2013.01)

(58) Field of Classification Search

CPC ..... F01C 21/0809; F01C 21/0818; F01C 21/0836; F01C 21/0863; F04C 2/3442; F04C 2/3445; F04C 2/3446; F04C 2/3447; F04C 18/3445–18/3447

USPC ..... 418/265, 259–260, 261–263, 264, 418/266–268, 150, 270

See application file for complete search history.

(56) References Cited

U.S. PATENT DOCUMENTS

| | | | | |
|---|---|---|---|---|
| 1,023,872 A * | 4/1912 | Pearson | F04C 2/3441 418/260 |
| 1,339,723 A * | 5/1920 | Smith | F01C 21/0836 418/265 |
| 1,492,456 A * | 4/1924 | Hansen-Ellehammer | F04C 2/3443 418/260 |
| 1,697,924 A * | 1/1929 | Lusso | F01C 21/0836 418/265 |
| 4,212,603 A | 7/1980 | Smolinski | |
| 5,002,473 A * | 3/1991 | Sakamaki | F01C 21/0836 418/265 |
| 5,087,183 A | 2/1992 | Edwards | |
| 5,160,252 A | 11/1992 | Edwards | |

(Continued)

FOREIGN PATENT DOCUMENTS

| | | | | |
|---|---|---|---|---|
| JP | 63124885 A * | 5/1988 | F01C 21/0836 |

*Primary Examiner* — Theresa Trieu

(57) ABSTRACT

A blade-type fluid transmission device includes a rotor eccentrically located in the room of a stator and the outer periphery of the rotor is tangent to the inner periphery of the room. At least one blade is pivotably connected to stator and movably inserted in at least one slot of the rotor. The distal end of the at least one blade is in contact with the inner periphery of the room so as to form a space for receiving fluid between the outer periphery of the rotor and the inner periphery of the room. The contact between the at least one blade and the inner periphery of the room increases the efficiency for transmitting fluid which enters into the stator from an inlet and leaves from the stator from an outlet.

3 Claims, 13 Drawing Sheets

(56) References Cited

U.S. PATENT DOCUMENTS

| | | | | |
|---|---|---|---|---|
| 5,181,843 | A | 1/1993 | Hekman et al. | |
| 5,558,511 | A | 9/1996 | Hedelin | |
| 6,273,694 | B1 | 8/2001 | Vading | |
| 6,905,322 | B1 * | 6/2005 | Simonds | F01C 21/0836 418/264 |
| 7,695,261 | B2 * | 4/2010 | Patterson | F01C 21/0836 418/265 |
| 8,985,983 | B2 * | 3/2015 | Yang | F04C 2/3442 418/150 |

* cited by examiner

BLADE-TYPE FLUID TRANSMISSION DEVICE

CROSS REFERENCE

The present application is Division of co-pending U.S. application Ser. No. 13/555,201 by the same inventors filed on Jul. 23, 2012.

FIELD OF THE INVENTION

The present invention relates to a fluid transmission device, and more particularly, to a blade-type fluid transmission device.

BACKGROUND OF THE INVENTION

The conventional blade-type pump generally comprises a stator, a rotor and at least one blade, wherein the stator has a room defined therein. The stator has an inlet and an outlet so that the room communicates with outside of the stator. Fluid enters into the room via the inlet and leaves the room via the outlet. The rotor is eccentrically located in the room and the outer periphery of the rotor is in contact with the inner periphery of the room. Multiple blades are taken as an example. The rotor has slots for accommodating the blades therein. The blades each have one end pointing the center of the rotor and the other end of each of the blades is in contact with the inner periphery of the room. A space is defined between the inner periphery of the room and the outer periphery of the rotor. By the contact between the rotor, the blades and the inner periphery of the room, multiple partitions are defined to receive fluid.

When the rotor rotates back and forth, the blades are driven by the rotor and movable back and forth within the slots due to the movement of the rotor. The volumes of the partitions vary due to the back-and-forth movement of the blades, so that the fluid is sucked into the room via the inlet and leaved from the room via the outlet.

The centrifugal force generated from the blades due to the rotation of the rotor drives the blades outward so as to contact the distal ends of the blades with the inner periphery of the room to pump the fluid. However, when the viscosity of the fluid is high, there will be a gap between the distal ends and the inner periphery of the room and the transmission efficiency of the fluid is reduced.

U.S. Pat. No. 4,212,603, U.S. Pat. No. 5,087,183, U.S. Pat. No. 5,160,252, U.S. Pat. No. 5,181,843 and U.S. Pat. No. 5,558,511 respectively discloses a fluid transmission device which comprises a stator with an annular groove which shares a common center with the room. The axles of the blades are engaged with the annular groove which guides the movement of the blades. The rotor is eccentrically located in the room and the axis of each of the blades points the center of the rotor, so that the shape of the inner periphery of the room is like oval inner periphery which is difficult to be machined during manufacturing processes. Furthermore, the blades each have a certain thickness, in order to prevent interference between two adjacent distal ends of the blades and the inner periphery of the room, the distal end of each blade is made to be sharpened. The sharp distal end of the blade may vibrate when the fluid passes therethrough and noise is therefore generated. The vibration also generates partial thermo stress which accelerates fatigue of the material at the distal end of the blade.

The present invention intends to provide a fluid transmission device which improves the shortcomings of the conventional fluid transmission devices.

SUMMARY OF THE INVENTION

The present invention relates to a fluid transmission device and comprises a stator having a room defined therein and the room has a circular inner periphery. The stator has an inlet and an outlet, the inlet and the outlet communicate with the room. A rotor has a cylindrical body and a shaft extends through the cylindrical body. The cylindrical body is eccentrically located in the room and the outer periphery of the cylindrical body is tangent to the inner periphery of the room. The inlet and the outlet are respectively located adjacent to the position where the outer periphery of the cylindrical body is tangent to the inner periphery of the room. Two slots are defined diametrically in the outer periphery of the cylindrical body and communicate with the room. The shaft extends through the stator and is connected with a power source. Two blades are respectively located within the slots. The first end of each blade points the axis of the cylindrical body and the second end of each blade is in contact with the inner periphery of the room so as to form a space for receiving fluid between the outer periphery of the cylindrical body and the inner periphery of the room.

Two first pieces and two second pieces are respectively pivotably connected to the stator, wherein the first pieces are located adjacent to the inner bottom of the cylindrical body and the second pieces are located adjacent to the inner top of the cylindrical body. The first pieces and the second pieces are pivoted about the center of the room. The two blades are respectively and pivotably connected to the first pieces and the second pieces by two respective axles. The blades are pivotable about the center of the room and linearly movable within the slots. A curved face is defined in the second end of each of the two blades and in contact with the inner periphery of the room. The inner periphery of the room has a radius R1. Each of the axles is pivotable by a radius R2. The curved face of the second end of each of the two blades has a radius R3. R3=R1−R2. The two blades and the first pieces are pivoted about two respective centers of the curved faces such that the second ends of the two blades are in contact with the inner periphery of the room.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
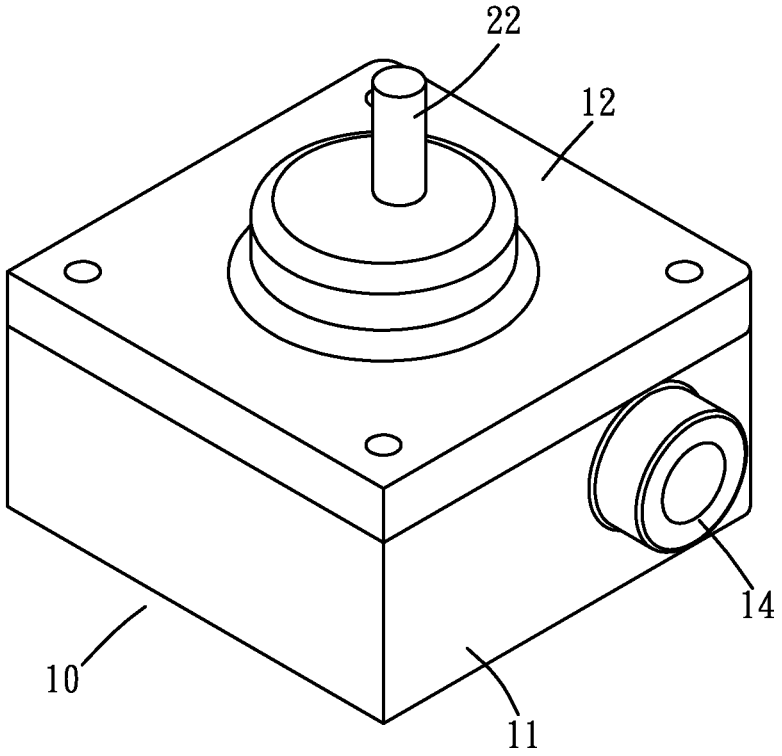
FIG. 1 is a perspective view to show the fluid transmission device of the present invention.
Figure 2:
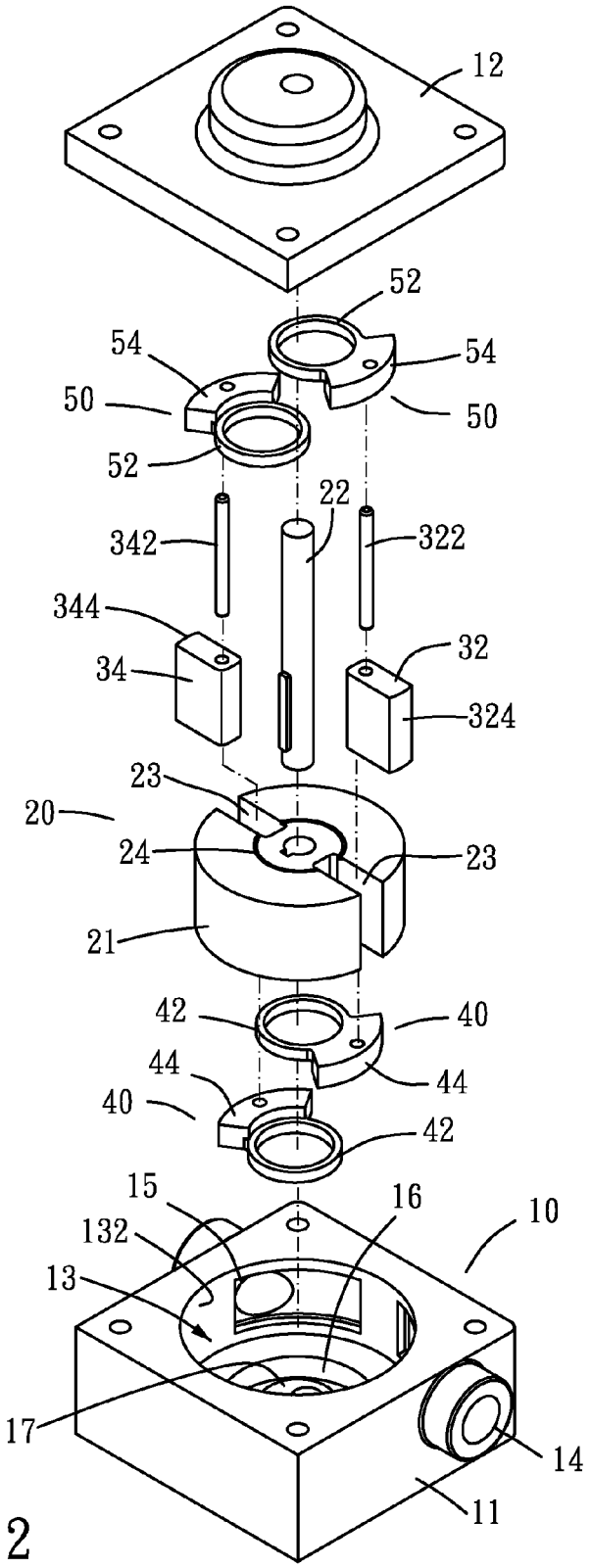
FIG. 2 is an exploded view to show the fluid transmission device of the present invention.
Figure 3:
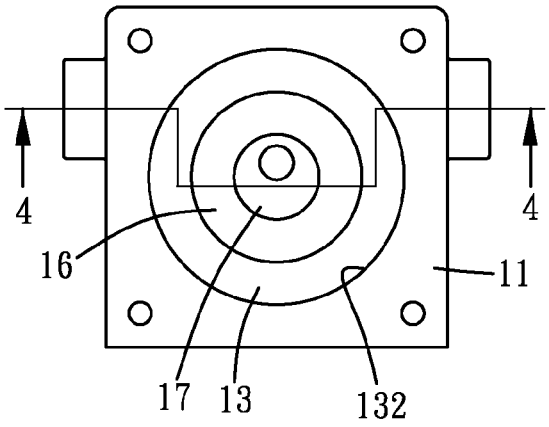
FIG. 3 is a top view of the base of the fluid transmission device of the present invention.
Figure 4:
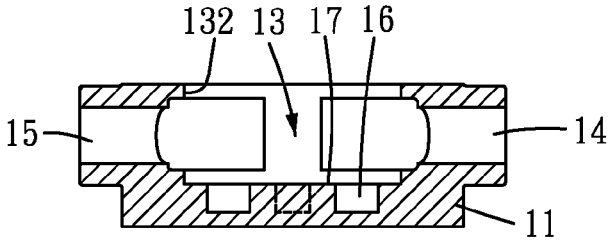
FIG. 4 is a cross sectional view taken along line 4-4 in FIG. 3.
Figure 5:
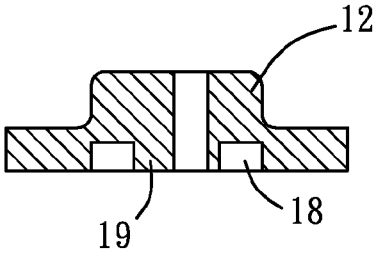
FIG. 5 is a cross sectional view of the cover of the fluid transmission device of the present invention.
Figure 6:
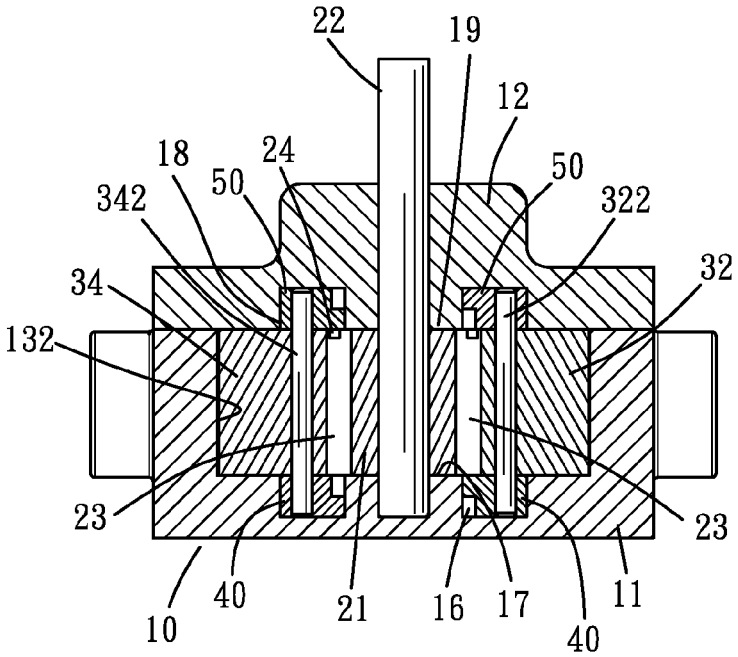
FIG. 6 is a cross sectional view of the fluid transmission device of the present invention.
Figure 7:
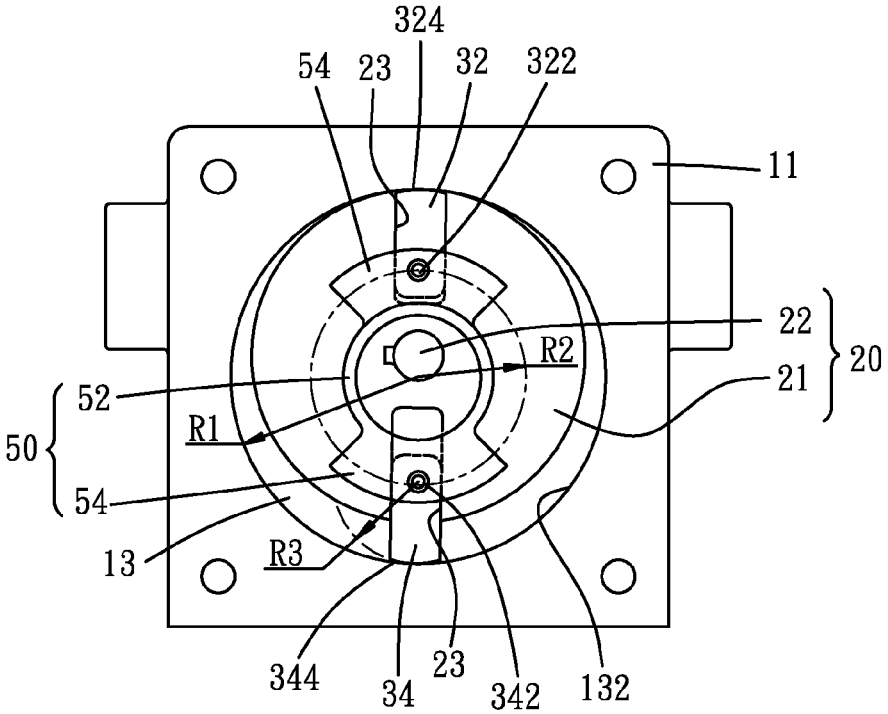
FIG. 7 is a top view to show the fluid transmission device of the present invention, wherein the cover is removed.

Referring to FIGS. 1 and 2, the fluid transmission device of the present invention comprises a stator 10, a rotor 20, two blades 32, 34, two first pieces 40 and two second pieces 50. The stator 10 comprises a base 11 and a cover 12 which is connected to the base 11. A sealing member (not shown) may be connected between the base 11 and the cover 12, and multiple bolts (not shown) are used to connect the base 11 and the cover 12. As shown in FIGS. 3 and 4, the stator 10 has a room 13 defined therein and the room 13 has a circular inner periphery 132. The stator 10 has an inlet 14 and an outlet 15. The inlet 14 and the outlet 15 communicate with the room 13 and outside of the stator 10. The stator 10 has a circular first recess 16 defined in the inner top of the room 13. A first protrusion 17 extends from the center of the first recess 16 and shares the center with the room 13. As shown in FIG. 5, the cover 12 has a second recess 18 defined in the underside thereof and faces the room 13. A second protrusion 19 extends from the center of the second recess 18 and shares the center with the room 13.

As shown in FIGS. 2 to 7, the rotor 20 has a cylindrical body 21 and a shaft 22 which extends through the cylindrical body 21. The cylindrical body 21 is eccentrically located in the room 13 and the outer periphery of the cylindrical body 21 is tangent to the inner periphery 132 of the room 13. The inlet 14 and the outlet 15 are respectively located adjacent to the position where the outer periphery of the cylindrical body 21 is tangent to the inner periphery 132 of the room 13. The shaft 22 has one end pivotably connected to the base 11 and the other end of the shaft 22 extends through the stator 10 so as to be connected with a power source such as a motor or an inverter motor (not shown). The shaft 22 is pivotably connected with a plurality of bearings or bushes (not shown) and the bearings are connected to the base 11 and the cover 12 so allow the shaft 22 to be rotated smoothly. Two slots 23 are defined diametrically in the outer periphery of the cylindrical body 21. One end of each of the slots 23 points the center of the cylindrical body 21 and the other end of each of the slots 23 communicates with the room 13. A groove 24 is defined in the end face of the cylindrical body 21 and two ends of the groove 24 respectively communicate with the slots 23. The two ends of the groove 24 are located close to the shaft 22.

The two blades 32, 34 are respectively located within the slots 23. The first end of each blade 32/34 points the axis of the cylindrical body 21, and the second end of each blade 32/34 is in contact with the inner periphery 132 of the room 13 so as to form a space for receiving fluid between the outer periphery of the cylindrical body 21 and the inner periphery 132 of the room 13.

The first pieces 40 and two second pieces 50 are respectively pivotably connected to the stator 10. The first pieces 40 are located adjacent to the inner bottom of the cylindrical body 21 and the second pieces 50 are located adjacent to the inner top of the cylindrical body 21. The first pieces 40 and the second pieces 50 are pivoted about the center of the room 13. Each of the first and second pieces 40, 50 comprises a ring 42/52 and a protrusion 44/54. The protrusion 44/54 is a curved protrusion and connected to the outer periphery of the ring 42/52. The first pieces 40 are pivotably connected to the first recess 16 so that the first pieces 40 are adjacent to the underside of the cylindrical body 21. The rings 42 of the first pieces 40 are mounted to the first protrusion 17 so that the first pieces 40 are pivotable about the center of the room 13. The second pieces 50 are pivotably connected to the second recess 18 so that the second pieces 50 are adjacent to the top of the cylindrical body 21. The rings 52 of the second pieces 50 are mounted to the second protrusion 19 so that the second pieces 50 are pivotable about the center of the room 13. The two blades 32, 34 are respectively and pivotably connected to the first pieces 40 and the second pieces 50 by two respective axles 322, 342. Two ends of the axle 342 are pivotably connected to the protrusions 44, 54 of the first and second pieces 40, 50. When the rotor 20 rotates, the first and second pieces 40, 50 drive the axles 322, 342 to make the blades 32, 34 be pivoted about the center of the room 13. In the meanwhile, the blades 32, 34 are linearly movable in the slots 23. The rings 42 are mounted to the first protrusion 17 so that when the first pieces 40 rotate, there will be no interference between the first pieces 40 and the first protrusion 17. Therefore, the rotation of the first pieces 40 is reliable. The rings 52 are mounted to the second protrusion 19 so that when the second pieces 50 rotate, there will be no interference between the second pieces 50 and the second protrusion 19. Therefore, the rotation of the second pieces 50 is reliable.

A curved face 324/344 is defined in the second end of each of the two blades 32, 34 and in contact with the inner periphery 132 of the room 13. The inner periphery 132 of the room 13 has a radius R1. Each of the axles 322, 342 is pivotable by a radius R2. The curved face 324/344 of the second end of each of the two blades 32, 34 has a radius R3. The relationship of the three radiuses can be expressed by the equation $R3=R1-R2$. The two blades 32, 34 and the first pieces 40 are pivoted about two respective centers of the curved faces 324, 344 (the axes of the axles 322, 342) such that the second ends of the two blades 32, 34 are in contact with the inner periphery 132 of the room 13. Therefore, the efficiency of transmission of the fluid is increased and the manufacturing processes for making the room 13 are simplified.

Figure 8:
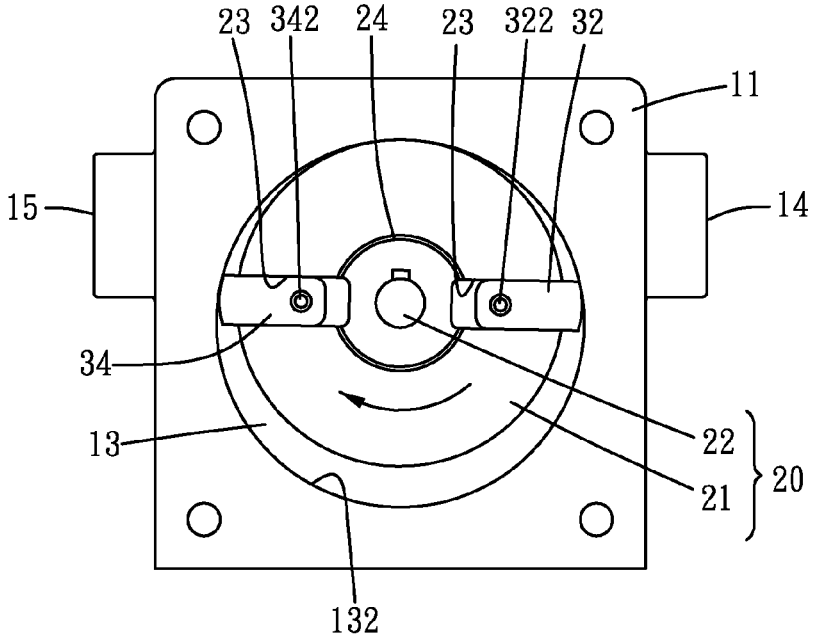
FIG. 8 is an operational status of the fluid transmission device of the present invention.
Figure 9:
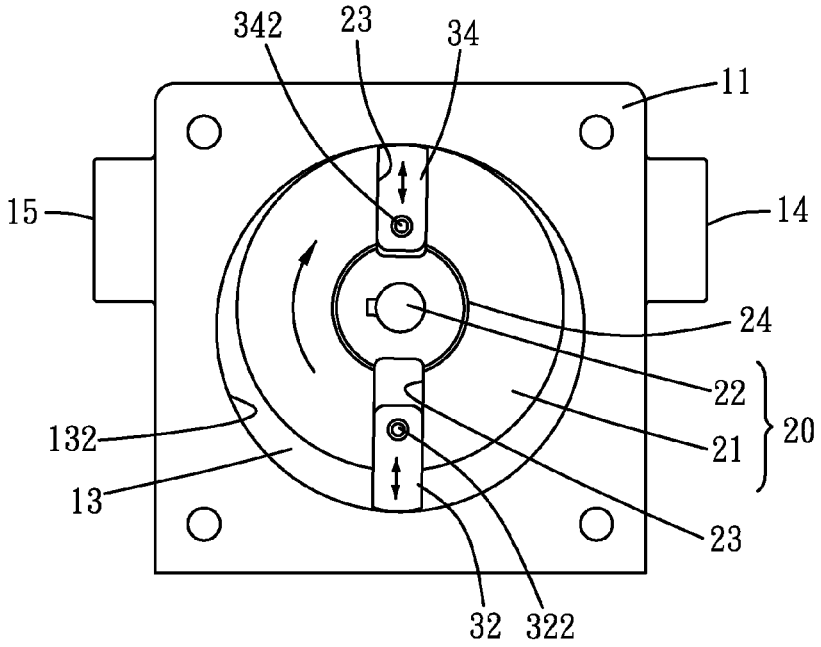
FIG. 9 is another operational status of the fluid transmission device of the present invention.

A power source (not shown) is connected to the shaft 22 to rotate the rotor 20, the blades 32, 34 are rotated about the center of the room 13 and, the blades 32, 34 are respectively rotated relative to the first and second pieces 40, 50. The blades 32, 34 are moved along the slots 23. When the rotor 20 rotates clockwise, as shown in FIGS. 8 and 9, the space for receiving fluid in the room 13 are varied along with the rotation of the rotor 20 in the room 13, such that the fluid is sucked into the room 13 via the inlet 14 and the fluid is transmitted by the blades 32, 34 and then flows out from the outlet 15. When the rotor 20 rotates counter-clockwise (not shown in FIGS. 8 and 9), the fluid is sucked into the room 13 via the outlet 15 and the fluid is transmitted by the blades 32, 34 and then flows out from the inlet 14. Therefore, by controlling the direction of rotation of the rotor 20, the fluid can be transmitted in desired direction.

When the rotor 20 rotates, the blades 32, 34 are rotated about the respective axles 322, 342, and the axles 322, 342 move circularly about the center of the room 13 By cooperation of the radius R3 of the curved faces 324, 344, the curved faces 324, 344 of the blades 32, 34 are in contact with the inner periphery 132 of the room 13 without interference so as to increase the efficiency of transmission of fluid. The inner periphery 132 of the room 13 is a round inner periphery which reduces the difficulties of machining.

Furthermore, when the blades 32, 34 move in the slots 23 back and forth, because the first ends of the two blades 32, 34 point the center of the room 13, and the two slots 23 are in communication with each other via the grooves 24, so that the fluid within the space between the two respective first ends of the blades 32, 34 and the shaft 22 flows between the two slots 23 via the grooves 24. This avoids the positive/negative pressure applied to the two blades 32, 34 so that the blades 32, 34 move smoothly. The number of the blades 32, 34 can be three or more than three, and the number of the pieces 40, 50 is also changed along with the change of the blades 32, 34. The number of the slots 23 is correspondingly changed to accommodate the blades 32, 34.

Figure 10:
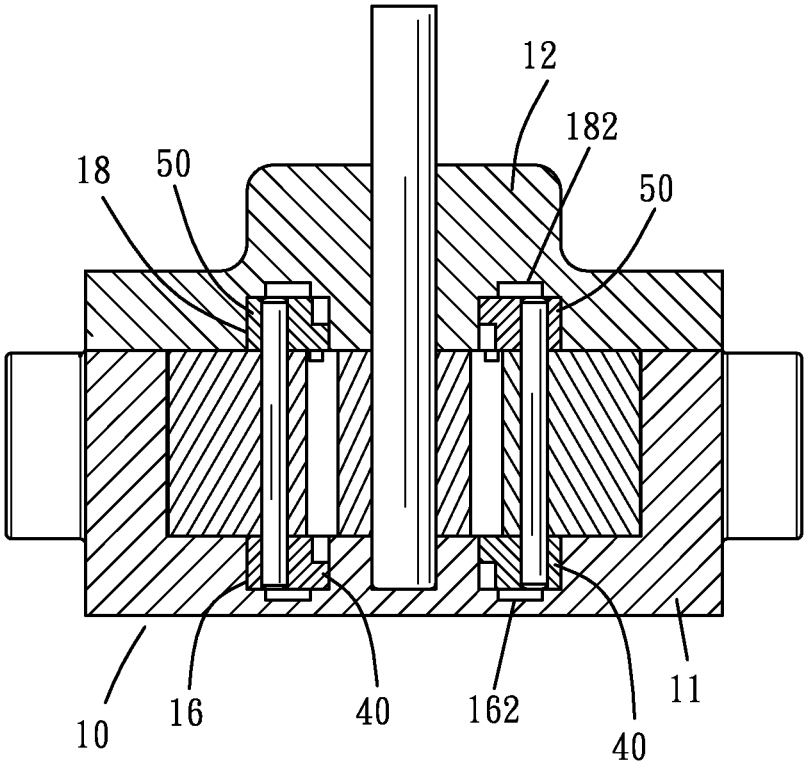
FIG. 10 is a cross sectional view of the second embodiment of the fluid transmission device of the present invention.

FIG. 10 shows the second embodiment, the differences between the first and second embodiments are that each of the first recesses 16 of the stator 10 has a first dim 162 in the inner end thereof so as to reduce the contact area between the first pieces 40 and the first recesses 16 and reduce the friction between the first pieces 40 and the base 11. Each of the second recess 18 of the stator 10 has a second dim 182 in the inner end thereof so as to reduce the contact area between the second pieces 50 and the second recesses 18 and reduce the friction between the second pieces 50 and the base 11. Lubricant is received in each of the first and second dims 162, 182.

Figure 11:
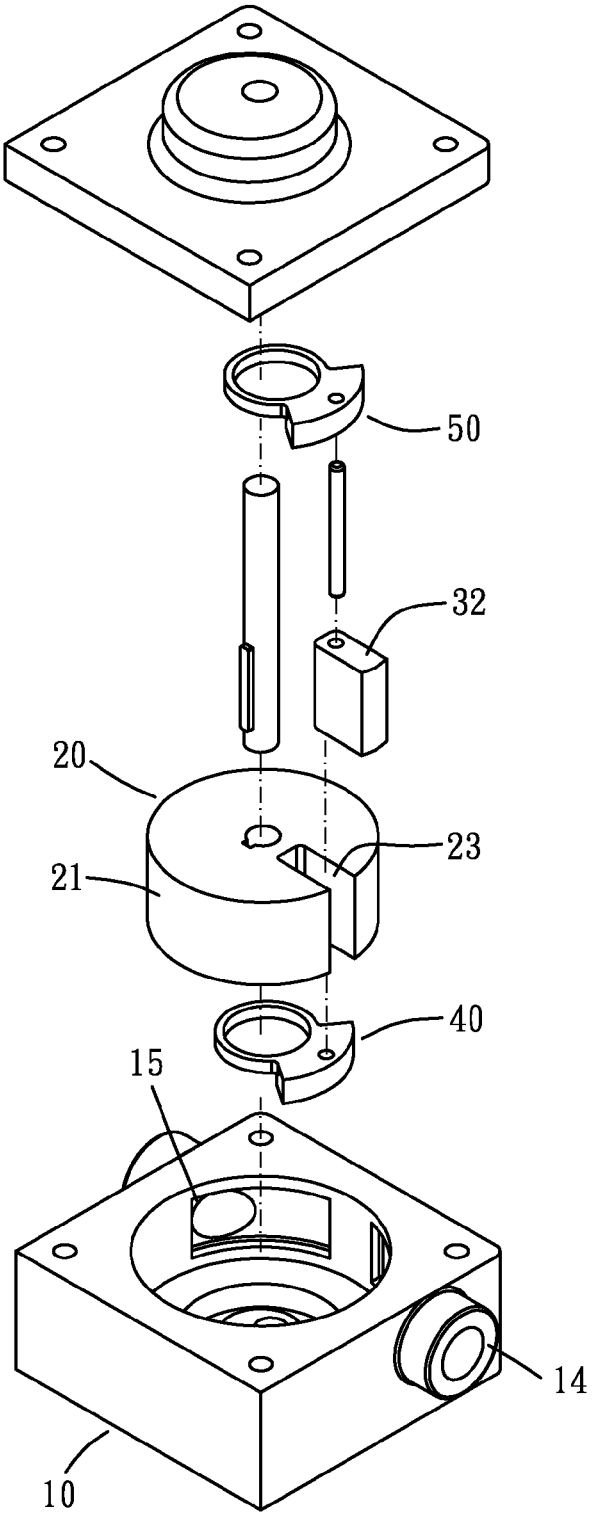
FIG. 11 is an exploded view to show the third embodiment of the fluid transmission device of the present invention.
Figure 12:
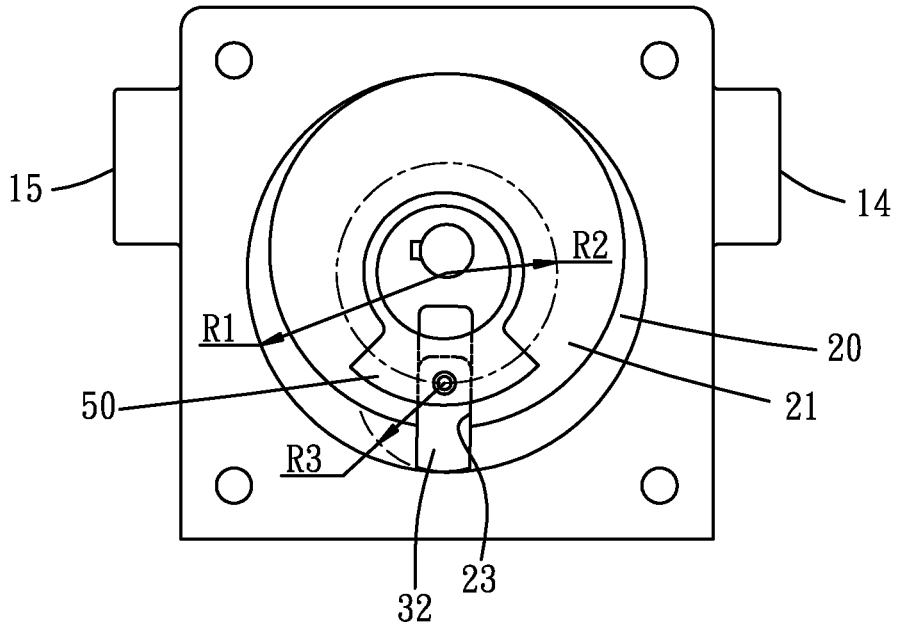
FIG. 12 is a top view to show the third embodiment of the fluid transmission device of the present invention, wherein the cover is removed.

FIGS. 11 and 12 show the third embodiment which comprises a stator 10, a rotor 20, a blade 32, a first piece 40 and a second piece 50. The differences between the first and third embodiments are that the slot 23 is defined radially in the outer periphery of the cylindrical body 21 and communicates with the room 13. The blade 32 is movable in the slot 23.

Each of the inlet 14 and the outlet 15 has a check valve (not shown) connected thereto so as to control the direction of the fluid.

Figure 13:
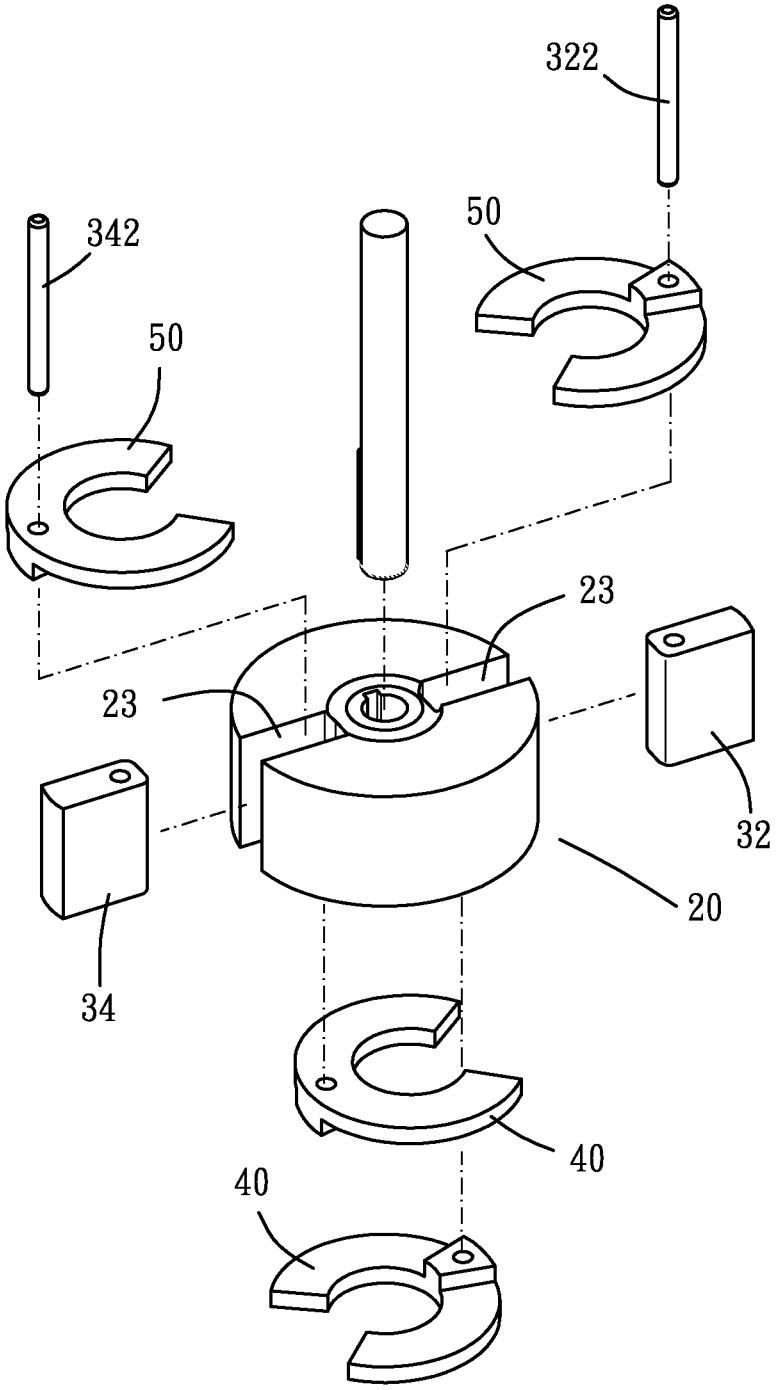
FIG. 13 is an exploded view to show the first piece, the second piece and the rotor of the fourth embodiment of the fluid transmission device of the present invention.

FIG. 13 shows the fourth embodiment wherein the differences between the first and fourth embodiments are that each of the first and second pieces 40, 50 are curved plates and an arc of each of the first and second pieces 40, 50 is over 180 degrees. Each of the first pieces 40 is pivotably connected to the first protrusion (not shown) of the stator (not shown) and each of the second pieces 50 is pivotably connected to the second protrusion (not shown) of the stator (not shown). The blade 32 is connected to an axle 322 which is pivotably connected between the first and second pieces 40, 50. The blade 34 is connected to an axle 342 which is pivotably connected between the first and second pieces 40, 50. When the rotor 20 rotates, the first and second pieces 40, 50 drive the blades 32, 34 by the axles 322, 342 and the blades 32, 34 rotate about the center of the room 13. The blades 32, 34 move along the slots 23 back and forth. Because the arc of each of the first and second pieces 40, 50 is over 180 degrees, the rotation of the first and second pieces 40, 50 is reliable.

Figure 14:
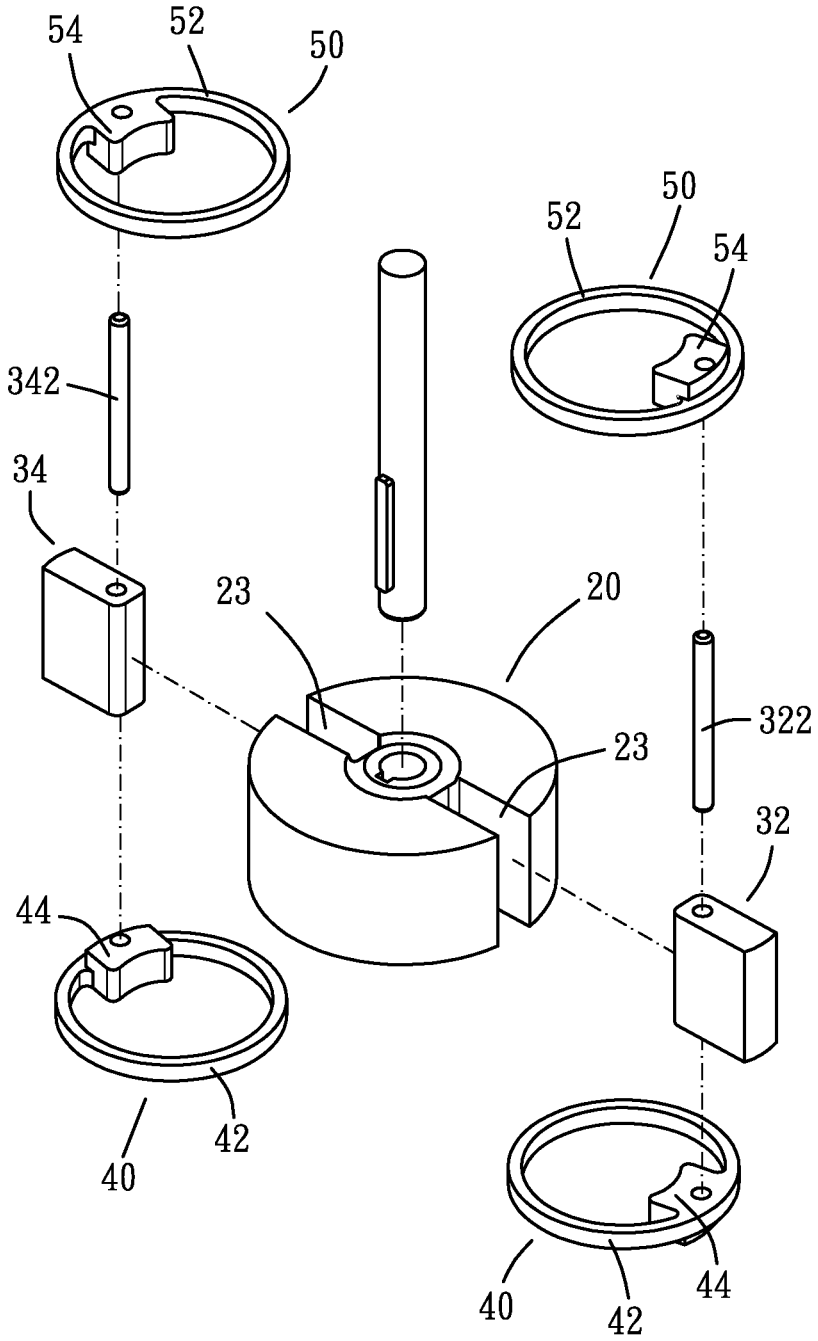
FIG. 14 is an exploded view to show the first piece, the second piece and the rotor of the fifth embodiment of the fluid transmission device of the present invention.

FIG. 14 shows the fifth embodiment of the present invention, wherein the differences between the first and fifth embodiments are that each of the first and second pieces 40, 50 comprises a ring 42/52 and a protrusion 44/54. The protrusion 44/54 is connected to the inner periphery of the ring 42/52. The protrusion 44/54 is a curved protrusion. The protrusion 44 of ring 42 of each of the first pieces 40 is in contact with the outer periphery of the first protrusion (not shown) of the stator (not shown). The outer periphery of the ring 42 of each of the first pieces 40 is in contact with the inner wall of the first recess 16. The protrusion 54 of ring 52 of each of the second pieces 50 is in contact with the outer periphery of the second protrusion (not shown) of the stator (not shown). The outer periphery of the ring 54 of each of the second pieces 50 is in contact with the inner wall of the second recess. The first and second pieces 40, 50 respectively rotate about the center of the room 13, because the outer periphery of the ring 44/54 is in contact with the inner periphery of the first/second recess, so that the rotation of the first and second pieces 40, 50 are reliable. The blade 32 is connected to an axle 322 which is pivotably connected between the protrusions 44, 54 of the first and second pieces 40, 50. The blade 34 is connected to an axle 342 which is pivotably connected between the protrusion 44, 54 of the other two first and second pieces 40, 50. When the rotor 20 rotates, the first and second pieces 40, 50 drive the blades 32, 34 by the axles 322, 342 and the blades 32, 34 rotate about the center of the room 13. The blades 32, 34 move along the slots 23 back and forth.

Figure 15:
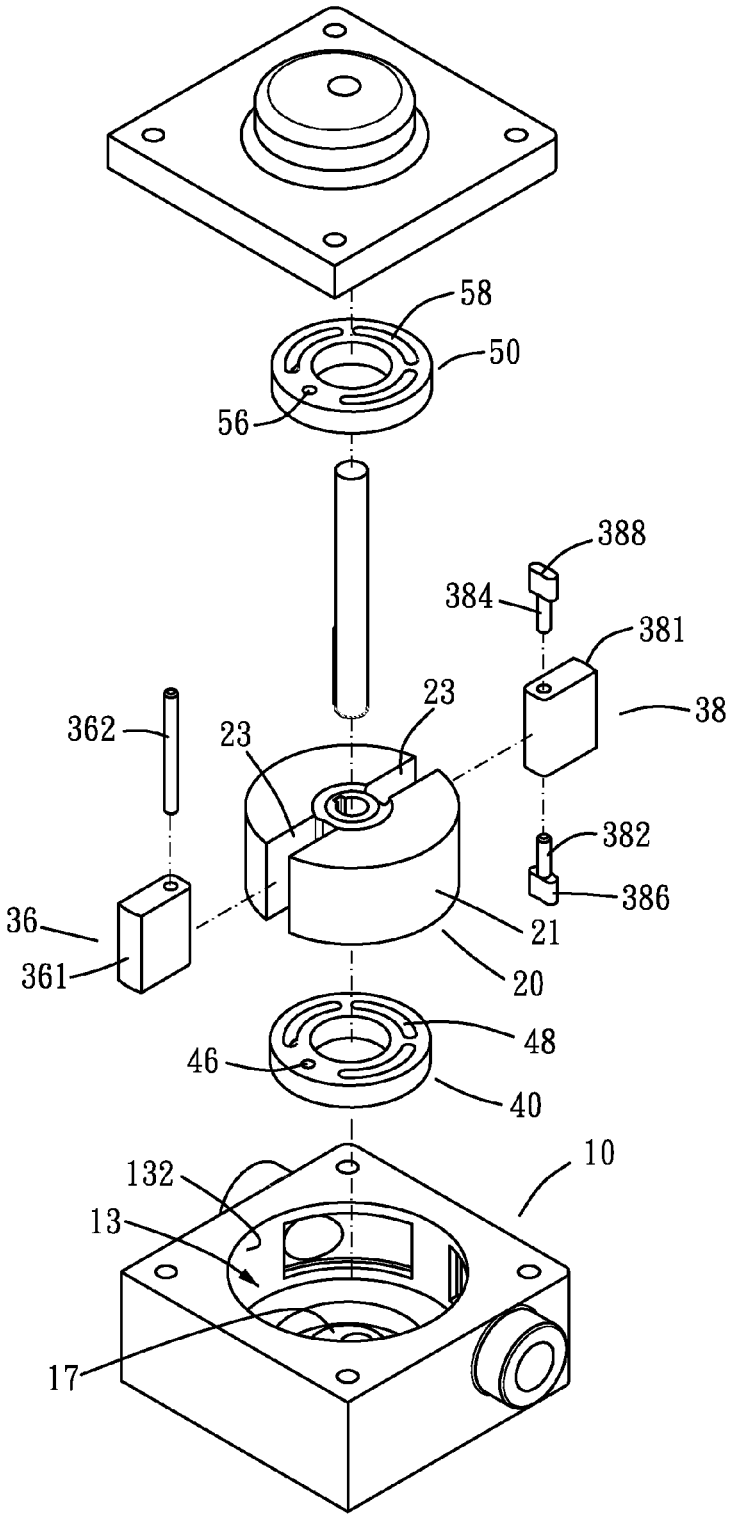
FIG. 15 is an exploded view to show the sixth embodiment of the fluid transmission device of the present invention.

FIG. 15 shows the sixth embodiment of the present invention and comprises a stator 10, a rotor 20, a first blade 36, a second blade 38, a first piece 40 and a second piece 50. The differences between the first and sixth embodiments are that the first and second pieces 40, 50 are ring-shaped pieces and the first pieces 40 are mounted to the first protrusion 17 and the second pieces 50 are mounted to the second protrusion (not shown). The first piece 40 and the second piece 50 are pivoted about the center of the room 13. The first and second pieces 40, 50 respectively form a pivotal hole 46/56 and a circular guide slot 48/58. The first blade 36 is pivotably connected to an axle 362 and two ends of the axle 362 are pivotably connected with the pivotal holes 46, 56 of the first and second pieces 40, 50. The first and second pieces 40, 50 drive the first blade 36 to pivot about the center of the room 13 by the axle 362. The second blade 38 is pivotably connected to a first axle 382 and a second axle 384. The first axle 382 is connected to a first slide 386 and the second axle 384 is connected to a second slide 388. The first slide 386 is slidably inserted into the guide slot 48 of the first piece 40 and the second slide 388 is slidably inserted to the guide slot 58 of the second piece 50. The first and second pieces 40, 50 drive the first and second axes 382, 384 to rotate the second blade 38 to be pivotable about the center of the room 13. The first and second slides 386, 388 are movable along with the guide slots 48, 58 back and forth.

Figure 16:
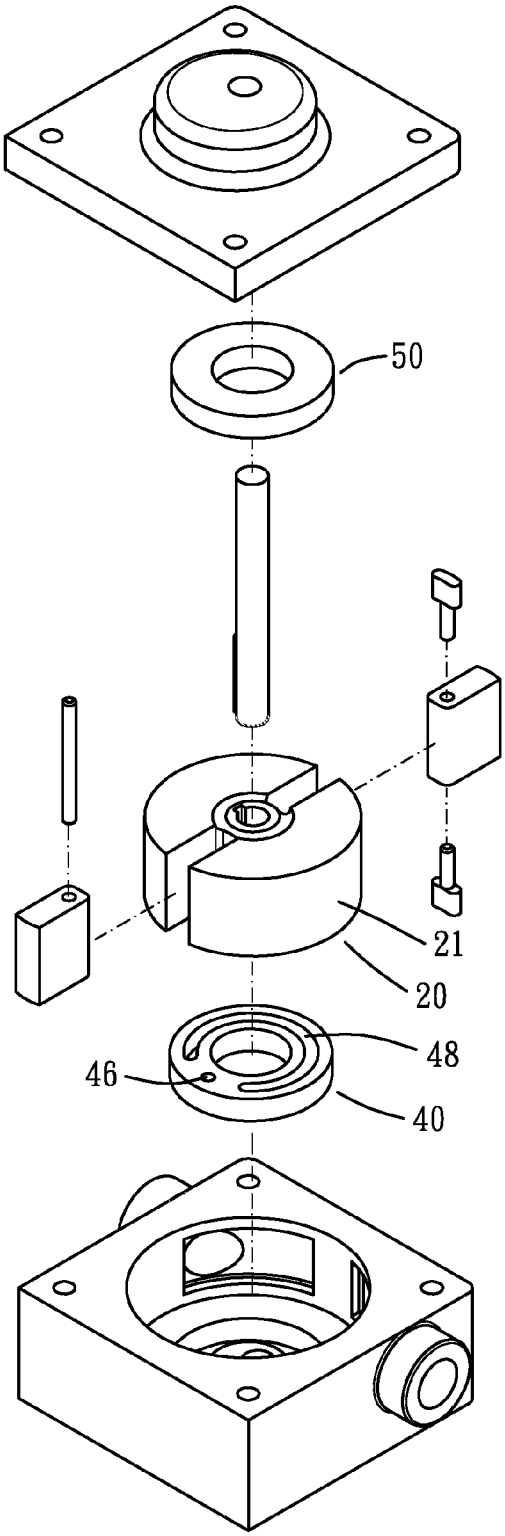
FIG. 16 is an exploded view to show the seventh embodiment of the fluid transmission device of the present invention.
Figure 17:
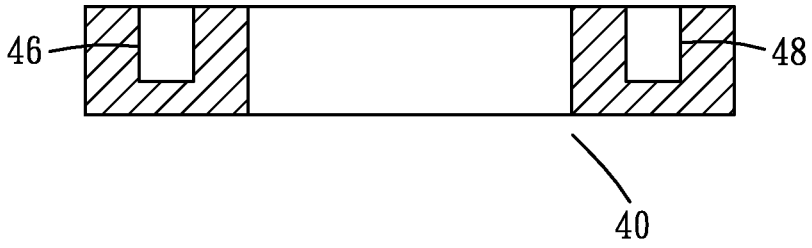
FIG. 17 is an axial cross sectional view of the first piece in the seventh embodiment of the fluid transmission device of the present invention.
Figure 18:
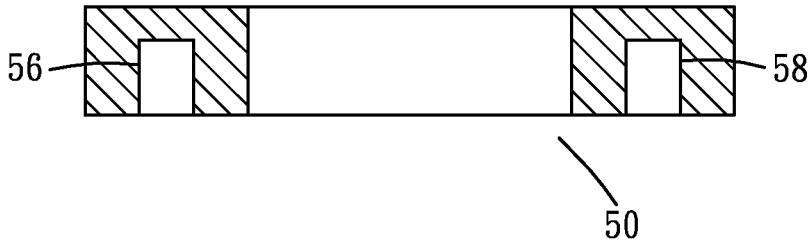
FIG. 18 is an axial cross sectional view of the second piece in the seventh embodiment of the fluid transmission device of the present invention.

FIG. 16 shows the seventh embodiment which is amended from the fifth embodiment, wherein the first and second pieces 40, 50 are located symmetrically relative to the cylindrical body 21. As shown in FIG. 17, the first piece 40 has a pivotal hole 46 and a curved guide slot 48. The pivotal hole 46 and the guide slot 48 are defined in the first side of the first piece 40, the second side of the first piece 40 is a closed side. As shown in FIG. 18, the second piece 50 has a pivotal hole 56 and a curved guide slot 58. The pivotal hole 56 and the guide slot 58 are defined in the first side of the second piece 50, and the second side of the second piece 50 is a closed side.

While inventor have shown and described the embodiment in accordance with the present invention, it should be clear to those skilled in the art that further embodiments may be made without departing from the scope of the present invention.

What is claimed is:

1. A fluid transmission device comprising:

a stator (10) having a room (13) defined therein and the room (13) having a circular inner periphery (132), the stator (10) having an inlet (14) and an outlet (15), the inlet (14) and the outlet (15) communicating with the room (13);

a rotor (20) having a cylindrical body (21) and a shaft (22) which extends through the cylindrical body (21), the cylindrical body (21) eccentrically located in the room (13), an outer periphery of the cylindrical body (21) being tangent to the inner periphery (132) of the room (13), the inlet (14) and the outlet (15) respectively located adjacent to a position where the outer periphery of the cylindrical body (21) is tangent to the inner periphery (132) of the room (13), two slots (23) defined diametrically in the outer periphery of the cylindrical body (21) and respectively communicating with the room (13), the shaft (22) extending through the stator (10) and adapted to be connected with a power source;

a first blade (36) and a second blade (38) located within the slots (23) respectively, a first end of each of the first and second blades (36, 38) pointing an axis of the cylindrical body (21), a second end of each of the first and second blades (36, 38) being in contact with the inner periphery (132) of the room (13) so as to form a space for receiving fluid between the outer periphery of the cylindrical body (21) and the inner periphery (132)) of the room (13);

a first piece (40) and a second piece (50) respectively and pivotably connected to the stator (10), the first piece (40) being located adjacent to an inner bottom of the cylindrical body (21) and the second piece (50) being located adjacent to an inner top of the cylindrical body (21), the first piece (40) and the second piece (50) pivoted about a center of the room (13), the first and second pieces (40, 50) respectively form a pivotal hole (46, 56) and a circular guide slot (48, 58);

the first blade (36) pivotably connected to an axle (362) and two ends of the axle (362) pivotably connected with the pivotal holes (46, 56) of the first and second pieces (40, 50), the second blade (38) pivotably connected to a first axle (382) and a second axle (384), the first axle (382) connected to a first slide (386) and the second axle (384) connected to a second slide (388), the first slide (386) slidably inserted into the guide slot (48) of the first piece (40) and the second slide (388) slidably inserted into the guide slot (58) of the second piece (50), the first and second blades (36, 38) pivotable about the center of the room (13), the first and second blades (36, 38) movable within the guide slots (23), and a curved face (361) defined in the second end of the first blade (36) and being in contact with the inner periphery (132) of the room (13), a curved face (381) defined in the second end of the second blade (38) and being in contact with the inner periphery (132) of the room (13), the inner periphery (132) of the room (13) having a radius R1, the axle (362) and the first and second axles (382, 384) being pivotable by a radius R2, the curved face (361, 381) of the first/second blade (36, 38) having a radius R3, R3=R1−R2, a center of the curved face (361) located at a center of the axle (362), a center of the curved face (381) located at a center of the first and second axles (382, 384), the second ends of the first and second blades (36, 38) being in contact with the inner periphery (132) of the room (13).

2. The device as claimed in claim 1, wherein the pivotal hole (46) and the guide slot (48) are defined in a first side of the first piece (40) faced to the rotor (20), a second side of the first piece (40) is a closed side, the pivotal hole (56) and the guide slot (58) are defined in a first side of the second piece (50) faced to the roor (20), a second side of the second piece (50) is a closed side.

3. The device as claimed in claim 1, wherein the pivotal hole (46) and the guide slot (48) are defined through the first piece (40), the pivotal hole (56) and the guide slot (58) are defined through the second piece (50).

* * * * *